US005340044A

United States Patent [19]

Doomernik et al.

[11] Patent Number: 5,340,044

[45] Date of Patent: Aug. 23, 1994

[54] METHOD OF MANUFACTURING A SADDLE-SHAPED DEFLECTION COIL FOR A PICTURE DISPLAY TUBE

[75] Inventors: Franciscus M. P. P. Doomernik; Franciscus C. A. J. Jacobs; Nicolaas G. Vink, all of Eindhoven, Netherlands

[73] Assignee: U.S. Philips Corporation, New York, N.Y.

[21] Appl. No.: 53,977

[22] Filed: Apr. 26, 1993

Related U.S. Application Data

[63] Continuation of Ser. No. 573,928, Aug. 23, 1990, abandoned.

[30] Foreign Application Priority Data

Jan. 9, 1990 [NL] Netherlands ..... 9000047

[51] Int. Cl.[5] ..... H01F 5/00

[52] U.S. Cl. ..... 242/7.03; 29/605; 242/7.09

[58] Field of Search ..... 242/7.01, 7.02, 7.03, 242/7.09; 29/605; 140/92.1, 92.2

[56] References Cited

U.S. PATENT DOCUMENTS

| | | | |
|---|---|---|---|
| 1,396,033 | 11/1921 | Francis | 242/7.09 |
| 2,448,672 | 9/1948 | Knauf, Jr. | 140/92.2 |
| 3,518,590 | 6/1970 | Gross et al. | 29/605 |
| 3,766,641 | 10/1973 | Metzler et al. | 242/7.03 |
| 3,855,694 | 12/1974 | Van Der Heijde | 29/605 |
| 3,968,566 | 7/1976 | Schubert | 29/605 |
| 4,217,937 | 8/1980 | Ache et al. | 140/92.1 |
| 4,547,238 | 10/1985 | Lenders | 242/7.03 |
| 4,612,525 | 9/1986 | Sluyterman | 355/213 |
| 4,819,323 | 4/1989 | Groothoff | 242/7.03 |
| 4,821,407 | 4/1989 | Van de Meerakker | 242/7.03 |
| 4,937,931 | 7/1990 | Jacobs et al. | 29/605 |

*Primary Examiner*—Katherine Matecki
*Attorney, Agent, or Firm*—Robert J. Kraus

[57] ABSTRACT

A method of continuously winding in a recess-shaped winding space a saddle-shaped, flared deflection coil having two arcuate connection portions at the ends and two interposed coil flanks. Since a plurality of evenly distributed projections is inserted into the winding space during winding, reset points are provided in portions where the coil flanks are wound, which reset points counteract possible wire positioning errors (so-called winding spread) giving rise to a spread of line astigmatism when the coil is combined with a display tube.

7 Claims, 2 Drawing Sheets

METHOD OF MANUFACTURING A SADDLE-SHAPED DEFLECTION COIL FOR A PICTURE DISPLAY TUBE

This is a continuation of application Ser. No. 07/573,928, filed on Aug. 23, 1990, now abandoned.

BACKGROUND OF THE INVENTION

The invention relates to a method of manufacturing a saddle-shaped deflection coil which flares out from a rear end towards a front end and is of the type having an arcuate connection portion at the front end, an arcuate connection portion at the rear end and two interposed coil flanks, said method comprising the steps of:

a. providing a jig having a recess formed between two jig sections, which recess has a shape which corresponds to the desired shape of the coil, for taking up continuously fed winding wire; and b. continuously feeding winding wire to the recess for forming a plurality of coil turns.

Winding saddle-shaped deflection coils, particularly saddle-shaped line deflection coils for use in picture display tubes, is a generally known technique. It is conventional practice to combine a set of saddle-shaped line deflection coils with a set of saddle-shaped field deflection coils or a set of field deflection coils toroidally wound on a core to form an electromagnetic deflection unit. The nominal design of the coils may be such that, for example, certain requirements with respect to the geometry of a raster scanned by means of the deflection unit on the display screen of a display tube and/or with respect to the convergence of the electron beams on the display screen are satisfied.

However, it has recently been found that in spite of a satisfactory nominal design certain combinations of deflection units and display tubes, particularly for use in colour monitors, sometimes exhibit a convergence error, the so-called line astigmatism whose magnitude differs from combination to combination.

SUMMARY OF THE INVENTION

It is one of the objects of the invention to reduce this spread of line astigmatism in a substantial manner.

The solution of the above-mentioned problem is based on the recognition that the structure of the coil flanks is disturbed during winding of a saddle-shaped (line) deflection coil because the recess between the two jig sections is not reproducibly filled. If the position of a wire piece wound in a coil flank at a given moment is not correct, there is a great risk that the position of the wire pieces which follow is not correct either. In other words, the winding spread is determined by the sum of disturbances of the positions of previously wound wire pieces. This winding spread is found to occur in saddle-shaped deflection coils in which the flank ends near the transition to the arcuate connection portion at the front end are divided into a number of sections by inserting pins into the winding space, so that a new starting point is formed, as it were, for each first turn of a section, which winding spread is also found to occur in saddle-shaped deflection coils without such a sectional division.

The method according to the invention is characterized by inserting, during step b, a plurality of evenly distributed projections into the recess at predetermined locations in each portion where a coil flank is formed, after a predetermined number of coil turns has been formed to provide reset points for subsequent coil turns.

In this manner a possibly disturbed structure of the flanks at a number of locations which are evenly distributed in the longitudinal direction of the coil and which may be particularly in alignment, is reset.

The number of projections to be (additionally) inserted per flank may be, for example two or three in the case of a coil in which projections for forming sections are usually inserted into the winding space near the two ends of a flank during winding, or, for example three, four or five projections in the case of a coil having a flank which is not divided into sections. This is also dependent on the coil length.

After winding, the copper filling degree of the flank portion, which is wound after the projections have been inserted, can be increased by means of a pressing operation (with the aid of a press die). Moreover, the angle at which the projections are inserted relative to the jig can be selected to obtain an optimum copper filling degree.

In addition to the above-mentioned possibilities of resetting and optimising the filling degree, the insertion of projections at locations which are regularly distributed in the longitudinal direction of the coil provides a third possibility, namely arranging. This is understood to mean that after a first and a second projection have been inserted, consecutive coil turns are guided from the first projection internally or externally along the second projection. This provides the possibility of, for example, trimming the convergence. All these aspects provide the possibility of drastically reducing (for example by 50%) the spread of line astigmatism of the finished combination of display tube and deflection unit when winding line deflection coils, while a desired convergence is maintained.

The above-mentioned advantages particularly apply when line deflection coils are wound because these are generally positioned closer to the electron beams than the field deflection coils so that, when they are being wound, spread errors become noticeable sooner. However, the invention may also be used to advantage when saddle-shaped field deflection coils are wound.

BRIEF DESCRIPTION OF THE DRAWING

Some embodiments of the invention will now be described in greater detail by way of example with reference to the accompanying drawings, in which.

DESCRIPTION OF THE PREFERRED EMBODIMENTS

Figure 1:
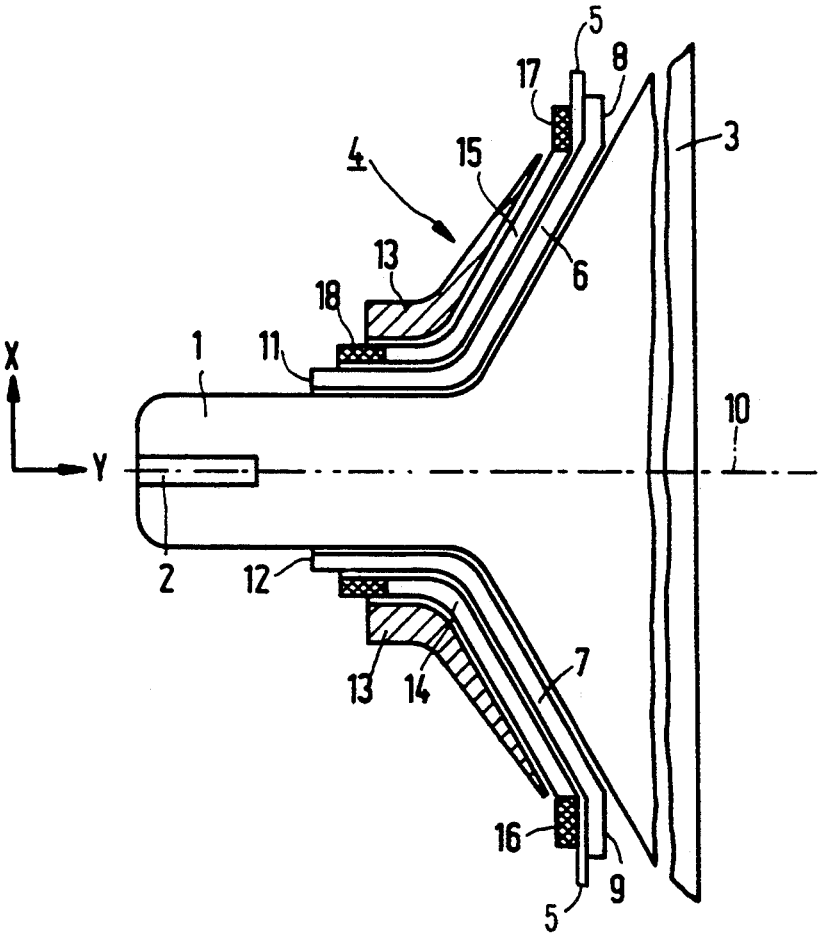
FIG. 1 is a diagrammatic longitudinal section of a portion of a picture display tube including a deflection unit.

FIG. 1 shows a colour display tube 1 comprising an electron gun system 2 for generating three electron beams directed towards a display screen 3 having a repetitive pattern of red, green and blue phosphor elements. An electromagnetic deflection system 4 is arranged coaxially with the axis of the tube around the path of the electron beams between the electron gun system 2 and the display screen 3. The deflection system 4 has a funnel-shaped synthetic material coil support 5 whose inner side supports a line deflection coil system including deflection coils 6, 7 for deflecting the electron beams generated by the electron gun system 3 in a horizontal direction. The flared line deflection coils 6, 7 are of the saddle type and have a front flange 8, 9 at their widest end, which flange is substantially located in a plane transverse to the axis 10 of the display tube. At their narrowest end the coils 6, 7 have packets of connection wires 11, 12 which connect the axial conductor packets of each coil 6, 7 to each other and are laid across the surface of the display tube 1. The coils 6, 7 are thus of the type having a "lying" rear flange and an "upstanding" front flange in the case shown. Alternatively, they may be of the type having an "upstanding" rear flange and an "upstanding" front flange, or of the type having a "lying" rear flange and a "lying" front flange.

At its outer side the coil support 5 supports two saddle-shaped field deflection coils 14, 15 for deflecting electron beams generated by the electron gun system 2 in a vertical direction. A ferromagnetic annular core 13 surrounds the two sets of coils. In the case shown the field deflection coils are of the type having an upstanding front flange 16, 17 and a lying rear flange. Alternatively, they may be of the type having an upstanding rear flange and an upstanding front flange or of the type having a lying rear flange and a lying front flange.

Figure 2:
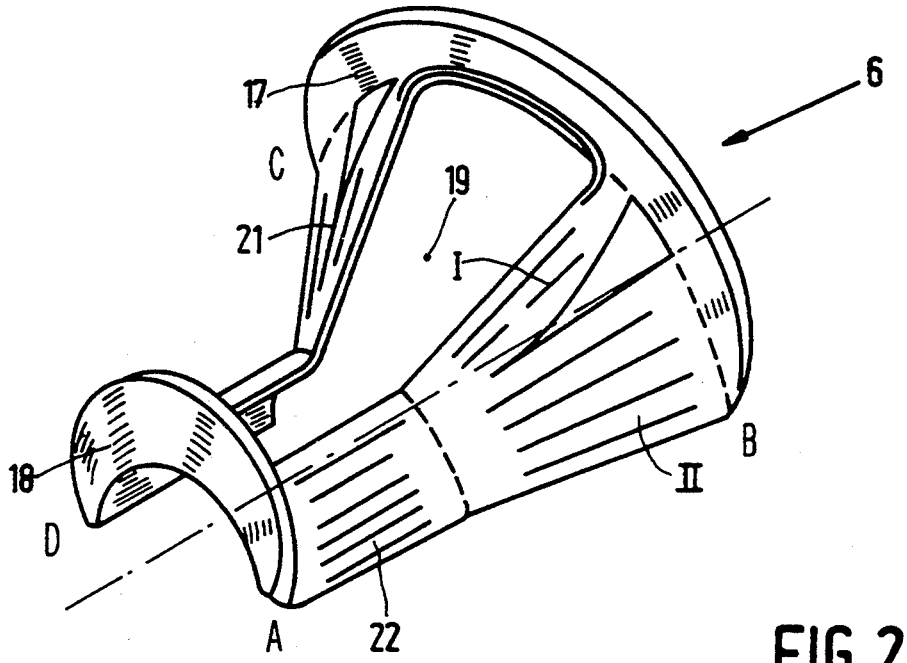
FIG. 2 is a perspective view of a conventional saddle-shaped deflection coil.

FIG. 2 shows a conventional line deflection coil 6 in a perspective view. This coil comprises a plurality of turns of, for example copper wire and has a rear end portion 18 and a front end portion 17 between which two flank portions 21, 22 extend on both sides of a window 19. As is shown in the Figure, the front end portion 17 and the rear end portion 18 are bent "upwards". This need not always be the case with the rear end portion 18. It is obvious that bending one or both end portions upwards or not upwards is a design parameter which is irrelevant to the measures according to the invention. All these possible embodiments are summarised under the term "saddle-shaped deflection coils". The coil 6 flares out from the rear to the front so that it is adapted to the funnel shape of the portion 5 of the picture display tube.

Figure 3:
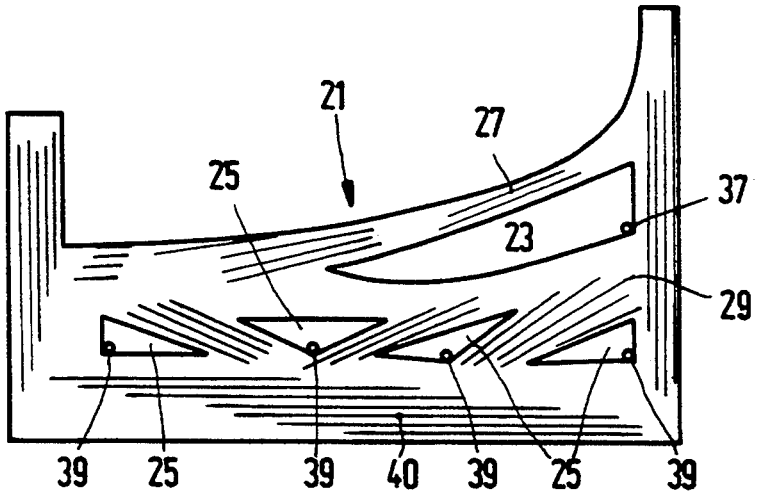
FIG. 3 is a side view of a saddle-shaped deflection coil manufactured by means of the method according to the invention.
Figure 4:
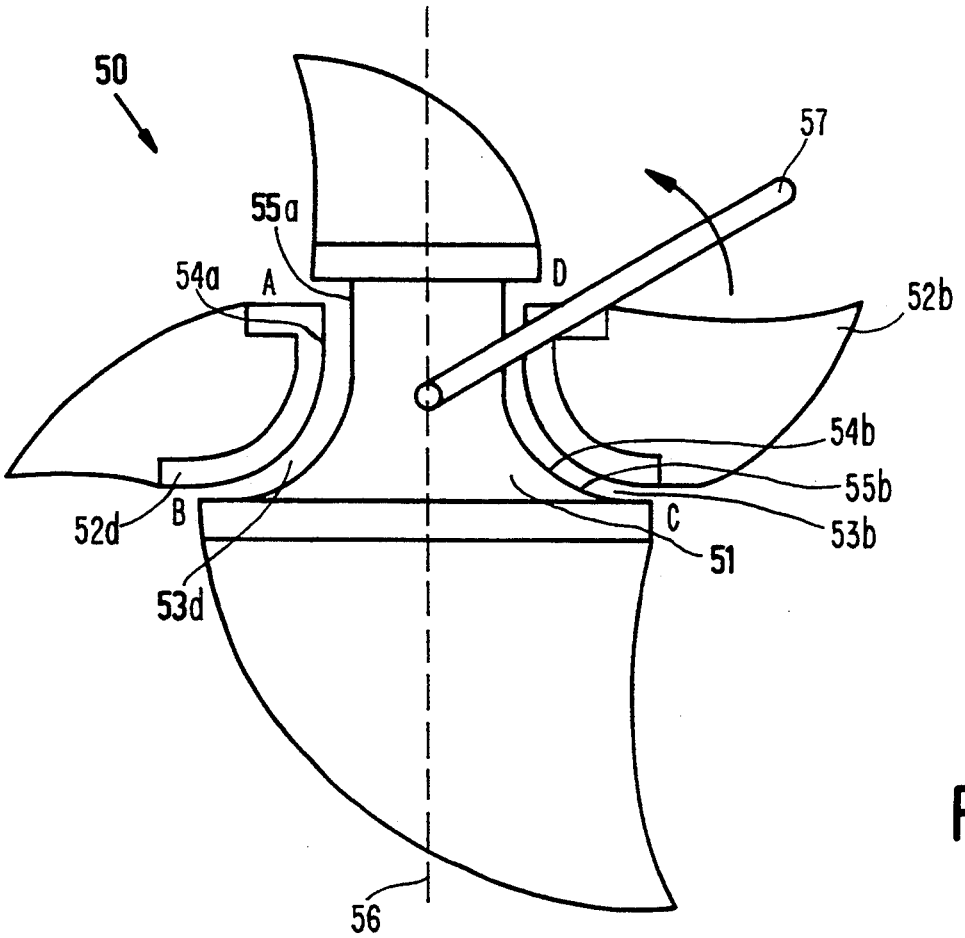
FIG. 4 is a diagrammatic cross-section of a winding jig suitable for the method according to the invention.

The magnetic flux required for deflecting electron beams is substantially entirely generated in the flank portions 21, 22. The flux generated in the end portions 18 and 17 substantially does not contribute to the deflection. Each of the flank portions 21, 22 may have a number of apertures near the transition to the front end for forming a number of sections. As is shown in the Figure, the deflection coil shown by way of example is divided into a first section I and a second section II. Each turn of the second section surrounds the turns of the first section which is located further inwards (closer to the window 19). By choosing the number, the location and the shape of the apertures near the front end as well as the number of turns in each section, a designer can influence the nominal distribution of the magnetic flux generated in the active portions 21, 22. The invention itself will now be described with reference to FIGS. 3 and 4. FIG. 3 is a diagrammatic side view of a (line) deflection coil during the inventive winding process. This winding process is carried out in recesses (winding spaces) 53*a*, 53*b* provided in a jig 50 which is shown in FIG. 4 and forms part of a winding machine. To simplify the Figure, the winding machine is not shown in detail. The jig 50 has two sections 51 and 52 (comprising separate parts 52*a*, 52*b*) between which the winding spaces 53*a*, 53*b* are recessed and are bounded by walls 54*a*, 55*a* and 54*b*, 55*b* having shapes corresponding to the outer boundaries of the coil to be wound. Positions A, B, C and D in the jig identify locations where the correspondingly-labeled portions of the coil shown in FIG. 2 are wound. As is well known in the art, winding of a coil in such a jig is carried out by alternately rotating the jig in opposite directions around an axis 56 while the wire is alternately guided into the spaces 53*a* and 53*b* by a winding arm 57 which rotates in the direction of the arrow.

During winding the inner coil section 27 is wound first (see FIG. 3), for example around a mandril defining the shape of the coil window 19 (see FIG. 2). As soon as the number of turns required for the section 27 is reached, two pins 37 located symmetrically with respect to the longitudinal axis and approximately perpendicularly to the plane of the turns are inserted substantially simultaneously into the part of the winding space where the front flange is formed, as in the example of FIG. 3. The first turn of the next section 29 is now laid around the pins 37 so that two apertures 23 are produced in the flank portions 21 between the sections 27 and 29. After the required number of turns of the second section 29 is reached, two or more pins 39 are inserted into the winding space. By "arranging" the turns, apertures 25 are produced. The winding operation is carried out continuously, i.e. the wire is fed without any interruption.

The apertures 25 approximately have the shape of a triangle. One side of this triangle coincides with the last turn of the section preceding the relevant aperture and the other sides coincide with the first turn of the turn subsequent to the aperture. As described hereinbefore, the currently used combinations of colour monitor tubes and deflection units exhibit a spread of line astigmatism. The invention is based on the recognition that this spread is predominantly due to the circumstance that the location of the wires in the flanks of the line deflection coils is not reproducible. If the winding space or jig recess is not reproducibly filled during the winding operation, the structure of the coil flanks may be disturbed. According to the embodiment of the invention illustrated in FIG. 3, the disturbed structure is reset at four locations in the flanks by inserting the pins 39 (which are in alignment). In fact, the winding spread which is responsible for the spread of line astigmatism is a sum of disturbances at the locations of previously wound wires.

After the winding operation a possible mispositioning of the wires can be corrected by means of pressing with a calibration die. However, this pressing operation is only effective if the filling degree is very high. The filling degree of the outer turn packet 40 is optimised as much as possible by optimally positioning the angle at which the pins 39 are inserted into the jig. The copper filling degree in the outer packet can thus be constantly corrected for at least 50%. By arranging wire packets between the pins 39 during the winding operation, the distribution of the wires can be influenced in such a way that the spread of line astigmatism is reduced by 50%, while the convergence properties are maintained.

We claim:

1. A method of manufacturing a saddle-shaped deflection coil which flares out from a rear end towards a front end and is of the type having an arcuate connection portion at the front end, an arcuate connection portion at the rear end, and first and second longitudinally-extending interposed coil flanks, said method comprising the steps of:

a. providing a jig having first and second sections forming a recess for taking up continuously fed winding wire, said recess having a shape corresponding to a predefined shape of the coil; and b. continuously feeding winding wire into the recess for forming a plurality of coil turns;

characterized in that, during step b, at least three substantially evenly distributed projections are inserted into the recess at predetermined locations along the length of each coil flank, after a predetermined plurality of coil turns has been formed, to provide reset points for subsequent coil turns.

2. A method of manufacturing a saddle-shaped deflection coil which flares out from a rear end towards a front end and is of the type having an arcuate connection portion at the front end, an arcuate connection portion at the rear end, and first and second interposed coil flanks, said method comprising the steps of:

a. providing a jig having first and second sections forming a recess for taking up continuously fed winding wire, said recess having a shape corresponding to a predefined shape of the coil; and b. continuously feeding winding wire into the recess for forming a plurality of coil turns;

characterized in that, during step b, along each of said flanks a first projection is inserted into the recess adjacent the front end, a second projection is inserted into the recess adjacent the rear end, and at least one intermediate projection is inserted into the recess along the flank between the first and second projections to provide a reset point for winding wire which is subsequently fed into the recess.

3. A method as claimed in claims 1 or 2, where the projections are inserted at an angle which is selected to obtain an optimum wire filling degree of the coil flanks.

4. A method as claimed in claim 2, where at least first and second ones of said intermediate projections are inserted into the recess and where a plurality of the coil turns are subsequently routed on opposite sides of said intermediate projections.

5. A method as claimed in claim 2, where at least first and second ones of said intermediate projections are inserted into the recess and where a plurality of the coil turns are subsequently routed on a common side of said intermediate projections.

6. A method as in claims 1 or 2 where the coil turns are wound around the inserted projections such that they form at least one longitudinally extending flank portion and at least one flank portion extending at an angle from said at least one longitudinally extending portion.

7. A method as in claims 1 or 2 where, along each coil flank, at least four projections are inserted into the recess at predetermined locations.

* * * * *